US007231160B2

(12) United States Patent
Ichikawa et al.

(10) Patent No.: US 7,231,160 B2
(45) **Date of Patent: *Jun. 12, 2007**

(54) PRINTING DEVICE AND PRINTING METHOD

(75) Inventors: Kazuhiro Ichikawa, Nagano (JP); Osamu Ishibashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

This patent is subject to a terminal disclaimer.

(21) Appl. No.: 10/881,012

(22) Filed: Jun. 30, 2004

(65) Prior Publication Data

US 2005/0025513 A1 Feb. 3, 2005

(30) Foreign Application Priority Data

Jul. 3, 2003 (JP) ..... 2003-190918

(51) Int. Cl.
*G03G 15/00* (2006.01)

(52) U.S. Cl. ..... 399/82; 399/85; 399/227

(58) Field of Classification Search ..... 399/85, 399/82, 227, 15, 29, 254
See application file for complete search history.

(56) References Cited

U.S. PATENT DOCUMENTS 5,839,018 A * 11/1998 Asanuma et al. ..... 399/43
7,085,520 B2 * 8/2006 Yamada et al. ..... 399/227
2003/0091370 A1 * 5/2003 Ono ..... 399/226
2004/0018030 A1 * 1/2004 Shiraki et al. ..... 399/227

FOREIGN PATENT DOCUMENTS

| | | |
|---|---|---|
| JP | 07-114260 | 5/1995 |
| JP | 11-184200 | 7/1999 |
| JP | 2001-183902 | 7/2001 |
| JP | 2003-280328 | 10/2003 |

* cited by examiner

*Primary Examiner*—David M. Gray
*Assistant Examiner*—Erika J. Villaluna
(74) *Attorney, Agent, or Firm*—Hogan & Hartson LLP

(57) ABSTRACT

A color laser printer of the invention identifies each object image to be printed as a color image or a monochromatic image. When the object image to be printed is identified as a color image, the control procedure of the invention rotates a developer unit with multiple color toner cartridges to sequentially move positions of the respective color toner cartridges to a development position and forms respective color toner images on a photoreceptor. When the object image to be printed is identified as a monochromatic image, on the other hand, the control procedure fixes a specific toner cartridge filled with black toner to the development position and forms a black toner image on the photoreceptor. A counter counts up consecutive monochromatic printing operations. After a preset number of the consecutive monochromatic printing operations in the fixed state of the developer unit, the developer unit is rotated to return and fix the specific toner cartridge filled with black toner to the development position for monochromatic printing.

15 Claims, 4 Drawing Sheets

(a)

(b)

PRINTING DEVICE AND PRINTING METHOD

BACKGROUND OF THE INVENTION

1. Field of the Invention

The present invention relates to a printing device and a corresponding printing method.

2. Description of the Prior Art

A known printing device has multiple toner cartridges that are arranged about a rotating shaft and are filled with toners of multiple colors used for color printing. This printing device exposes a charged photoreceptor to form electrostatic latent images for respective color components and rotates the rotating shaft to sequentially move the positions of the multiple toner cartridges to a development position, where each color toner image is formed on a photoreceptor with a supply of corresponding color toner from one of the multiple toner cartridges located at the development position. As is known in the art, in order to make the density of each toner uniform and ensure printed images of stable quality, the toner cartridges in the printing device are rotated occasionally to agitate the toners kept therein (see, for example, Japanese Patent Laid-Open Gazette No. 11-184200). Monochromatic printing is typically performed with rotation of the toner cartridge as in the case of color printing.

SUMMARY OF THE INVENTION

Rotation of the toner cartridge for monochromatic printing undesirably causes noise, while advantageously making the density of each toner uniform and ensuring even and homogeneous printing of toner images.

The object of the present invention is to provide a printing device and a printing method that execute a monochromatic printing with reduced noise. The object of the present invention is also to provide a printing device and a printing method that execute a monochromatic printing while ensuring even and homogeneous printing of toner images.

In order to attain at least part of the above and the other related objects, the printing device and the printing method of the present invention is constructed as follows.

The present invention is directed to a printing device that is capable of printing in a color print mode and printing in a monochromatic print mode. The printing device includes: multiple toner cartridges that are attached to the printing device and are respectively filled with toners of multiple colors used for color printing; a changeover mechanism that sequentially moves positions of the multiple toner cartridges to a development position, where each color toner image is formed on a photoreceptor with a supply of corresponding color toner from the toner cartridge located at the development position; a mode identification module that identifies either the color print mode or the monochromatic print mode; and a changeover control module that controls the changeover mechanism, in response to identification as the color print mode by the mode identification module, to sequentially move the positions of the multiple toner cartridges to the development position and form respective color toner images on the photoreceptor, the changeover control module controlling the changeover mechanism, in response to identification as the monochromatic print mode by the mode identification module, to fix the position of a specific toner cartridge filled with a specific color toner used for monochromatic printing to the development position and form a monochromatic toner image on the photoreceptor.

The printing device of the invention first identifies either the color print mode or the monochromatic print mode. In response to identification as the color print mode, the printing device sequentially moves the positions of the multiple toner cartridges to the development position and forms respective color toner images on the photoreceptor. In response to identification as the monochromatic print mode, on the other hand, the printing device fixes the position of the specific toner cartridge filled with the specific color toner used for monochromatic printing to the development position and forms a monochromatic toner image on the photoreceptor. This arrangement desirably reduces the noise, compared with the prior art structure that forms monochromatic toner images on the photoreceptor while moving the position of the specific toner cartridges in the monochromatic print mode.

In one preferable embodiment of the printing device of the invention, the changeover mechanism rotates a rotating shaft, around which the multiple toner cartridges are arranged, to sequentially move the positions of the multiple toner cartridges to the development position.

In another preferable embodiment, the printing device of the invention further includes a mode information acquisition module that obtains mode information representing a user's selection of either the color print mode or the monochromatic print mode, and the mode identification module identifies either the color print mode or the monochromatic print mode, based on the mode information obtained by the mode information acquisition module. In still another preferable embodiment, the printing device of the invention further includes an image color judgment module that judges object image data to be printed as color image data or monochromatic image data, and the mode identification module identifies either the color print mode or the monochromatic print mode, based on a judgment result by the image color judgment module.

In another preferable embodiment of the invention, the printing device further includes: a frequency measurement module that measures a number of consecutive printing operations in the monochromatic print mode; and a measured frequency judgment module that determines whether the number of consecutive printing operations in the monochromatic print mode measured by the frequency measurement module reaches a preset number. In this embodiment, in response to determination of the measured frequency judgment module that the measured number of consecutive printing operations in the monochromatic mode reaches the preset number, the changeover control module controls the changeover mechanism to once move the positions of the multiple toner cartridges and then fix the position of the specific toner cartridge filled with the specific color toner for monochromatic printing to the development position to form the monochromatic toner image on the photoreceptor. Here any method may be applied to measure the number of consecutive printing operations. For example, the frequency of operations of the photoreceptor or a fixation unit or the count of prints may be used to specify the number of consecutive printing operations. The 'preset number' may be empirically or experimentally determined by repeatedly carrying out printing in the monochromatic print mode and counting up the number of prints with evenly and homogeneously formed toner images.

In another preferable embodiment of the invention, the printing device further includes: a time measurement module that measures a time of consecutive printing in the monochromatic print mode; and a measured time judgment module that determines whether the time of consecutive printing in the monochromatic print mode measured by the time measurement module reaches a preset value. In this embodiment, in response to determination of the measured time judgment module that the measured time of consecutive printing in the monochromatic mode reaches the preset value, the changeover control module controls the changeover mechanism to once move the positions of the multiple toner cartridges and then fix the position of the specific toner cartridge filled with the specific color toner for monochromatic printing to the development position to form the monochromatic toner image on the photoreceptor. The 'preset value' may be empirically or experimentally determined by repeatedly carrying out printing in the monochromatic print mode and measuring the time of consecutive monochromatic printing with evenly and homogeneously formed toner images.

In another preferable embodiment of the invention, the printing device further includes a density measurement module that measures a density of an image formed in the monochromatic print mode. In this embodiment, in response to a detection that the density of the image measured by the density measurement module is lower than a preset level in the monochromatic print mode, the changeover control module controls the changeover mechanism to once move the positions of the multiple toner cartridges and then fix the position of the specific toner cartridge filled with the specific color toner for monochromatic printing to the development position to form the monochromatic toner image on the photoreceptor. The 'preset level' may be empirically or experimentally determined by repeatedly carrying out printing in the monochromatic print mode and measuring the density of prints with evenly and homogeneously formed toner images.

The present invention is also directed to a printing method attained by a computer software program that sequentially moves positions of multiple toner cartridges, which are respectively filled with toners of multiple colors used for color printing, to a development position, where each color toner image is formed on a photoreceptor with a supply of corresponding color toner from one of the multiple toner cartridges located at the development position. The printing method includes the steps of: (a) identifying either a color print mode or a monochromatic print mode; and (b) sequentially moving the positions of the multiple toner cartridges to the development position and form respective color toner images on the photoreceptor in case of identification as the color print mode by the step (a), while fixing the position of a specific toner cartridge filled with a specific color toner used for monochromatic printing to the development position and form a monochromatic toner image on the photoreceptor in case of identification as the monochromatic print mode by the step (a).

The printing method of the invention first identifies either the color print mode or the monochromatic print mode. In response to identification as the color print mode, the printing method sequentially moves the positions of the multiple toner cartridges to the development position and forms respective color toner images on the photoreceptor. In response to identification as the monochromatic print mode, on the other hand, the printing method fixes the position of the specific toner cartridge filled with the specific color toner used for monochromatic printing to the development position and forms a monochromatic toner image on the photoreceptor. This arrangement desirably reduces the noise, compared with the prior art structure that forms monochromatic toner images on the photoreceptor while moving the position of the specific toner cartridges in the monochromatic print mode. Any of the arrangements of the printing device described above may be applied to the printing method of the invention. The printing method may have additional steps to actualize the various additional functions of the printing device described above.

The present invention is also applicable to a computer program that causes one or multiple computers to execute respective steps of the printing method described above. The program may be recorded in a computer readable recording medium (for example, a hard disk, a ROM, an FD, a CD, or a DVD), may be transferred from one computer to another computer via a transfer medium (a communication network like the Internet or a LAN), or may be transmitted in any other suitable form. Causing one computer to execute all the procedures or causing multiple computers to share execution of the procedures exerts the equivalent effects to those of the printing method described above.

DESCRIPTION OF THE PREFERRED EMBODIMENTS

Figure 1:
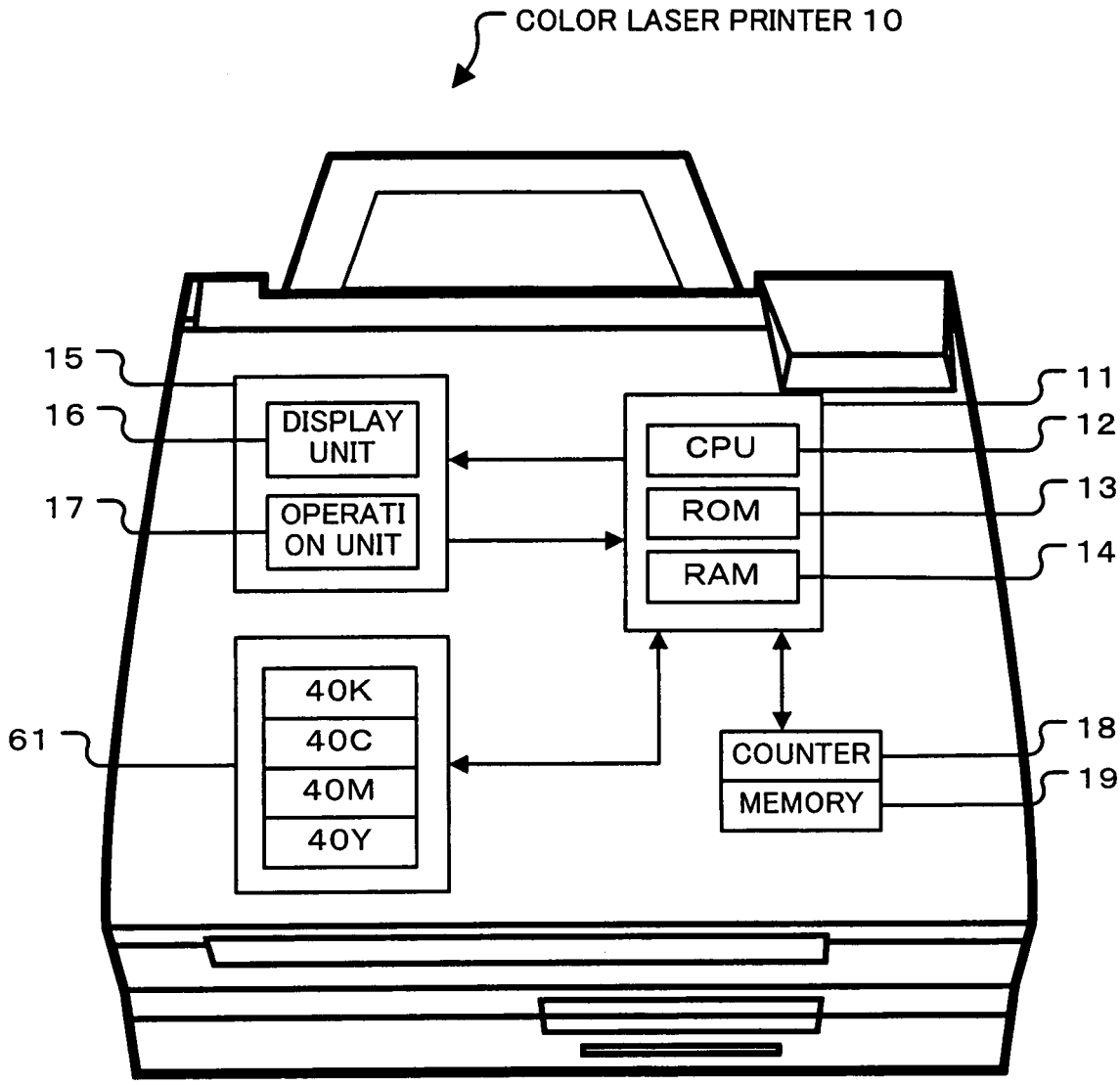
FIG. 1 schematically illustrates the structure of a color laser printer 10 in one embodiment.

One mode of carrying out the invention is discussed below with reference to the accompanied drawings. FIG. 1 schematically illustrates the structure of a color laser printer 10 in one embodiment of the invention. The color laser printer 10 mainly includes a controller 11, an operation panel 15, a counter 18, and a developer unit 61. The controller 11 is constructed as a known microprocessor including a CPU 12, a ROM 13 that stores processing programs, and a RAM 14 that temporarily stores data. The operation panel 15 has a display unit 16 to display various pieces of information and an operation unit 17 manipulated to input various pieces of information into the controller 11 through button operation and panel touch. The counter 18 counts up printing operations in a monochromatic print mode and stores the count into a flash memory 19. In the color laser printer 10 of the embodiment, the count is incremented by one on completion of printing one sheet of printing paper in the monochromatic print mode. The developer unit 61 is a four-cycle rotary developer unit having four toner cartridges 40 of respective color toners arranged around a rotating shaft 61*a* (see FIG. 2). The four toner cartridges 40 are respectively filled with four color toners. Namely there are four color toner cartridges 40C, 40M, 40Y, and 40K of the respective colors. These four color toner cartridges 40C, 40M, 40Y, and 40K are detachably attached to the color laser printer 10 as described later. All the four color toner cartridges 40C, 40M, 40Y, and 40K are attached to and used for color printing, whereas at least the black toner cartridge 40K is attached to and used for monochromatic printing.

Figure 2:
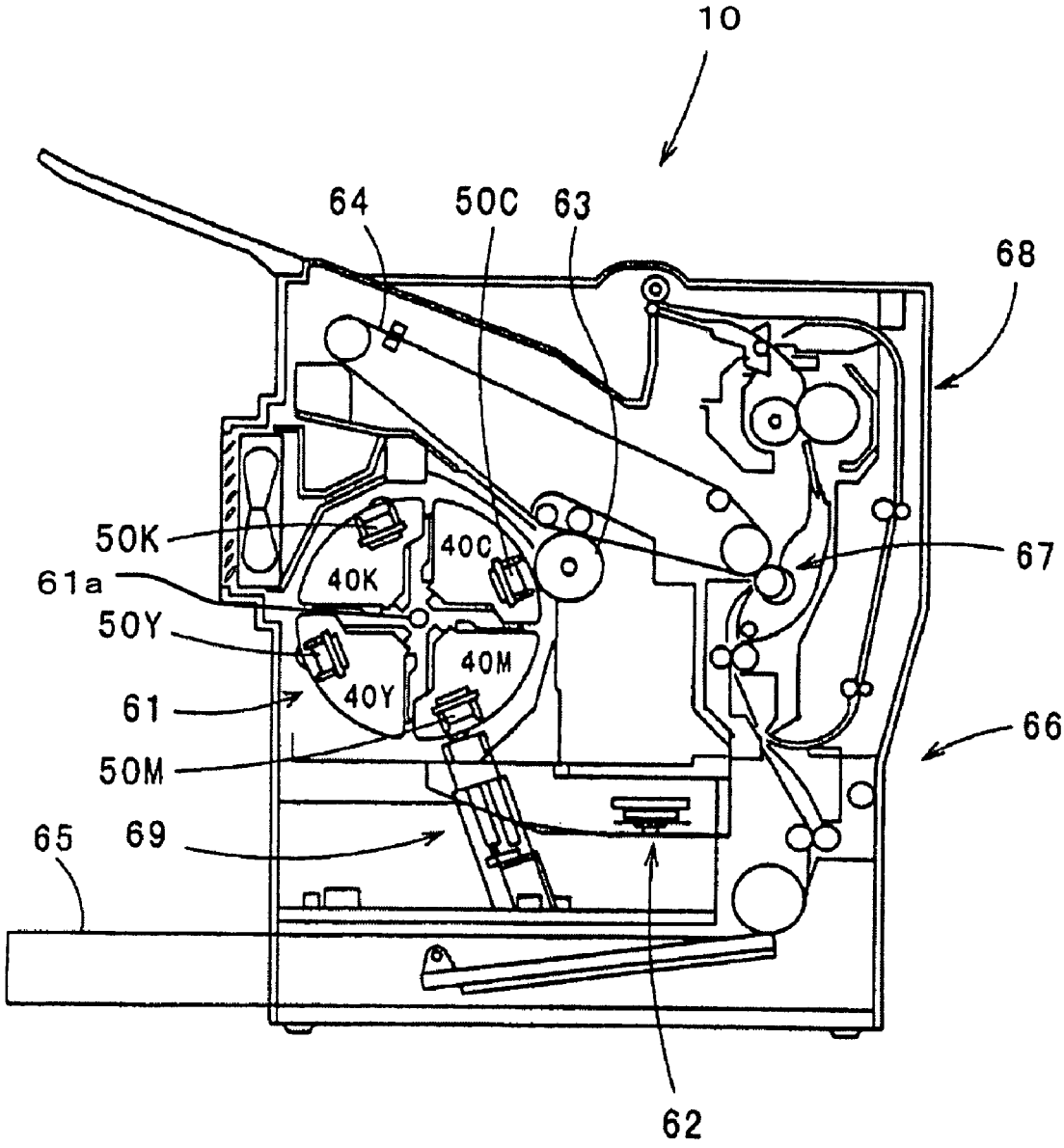
FIG. 2 schematically illustrates a sectional view of the color laser printer 10.

The color laser printer 10 including the developer unit 61 with the four toner cartridges 40 attached thereto is constructed as a full-color electrophotographic printing device that adopts a single photoreceptor system and an intermediate transfer system, as shown in FIG. 2. An exposure unit 62 forms color-separated images of four color components, cyan (C), magenta (M), yellow (Y), and black (K), as electrostatic latent images on a photoreceptor 63. The developer unit 61 is rotated to sequentially move the positions of the toner cartridges 40C, 40M, 40Y, and 40K attached thereto and to develop the electrostatic latent images formed on the photoreceptor 63 as toner images of the respective colors with supplies of corresponding color toners from the toner cartridges 40C, 40M, 40Y, and 40K. The respective color toner images are primarily transferred in an overlapping manner onto a transfer belt 64 functioning as an intermediate transfer body. A secondary transfer unit 67 further transfers the four color toner images, which have been primarily transferred to the transfer belt 64 in the overlapping manner, as a composite color toner image onto a sheet of printing paper fed from a paper cassette 65 and conveyed by a feeder unit 66. The composite color toner image transferred to the printing paper is fused and fixed on the printing paper by a fixation unit 68. This forms a resulting color image on the printing paper. The developer unit 61 is designed to be rotatable and to successively form toner images of the respective colors on the photoreceptor 63. The exposure unit 62 has a known structure that irradiates the photoreceptor 63 with laser beam, which is scanned by means of a polygon mirror driven and rotated by a motor, to form the electrostatic latent images.

Figure 3:
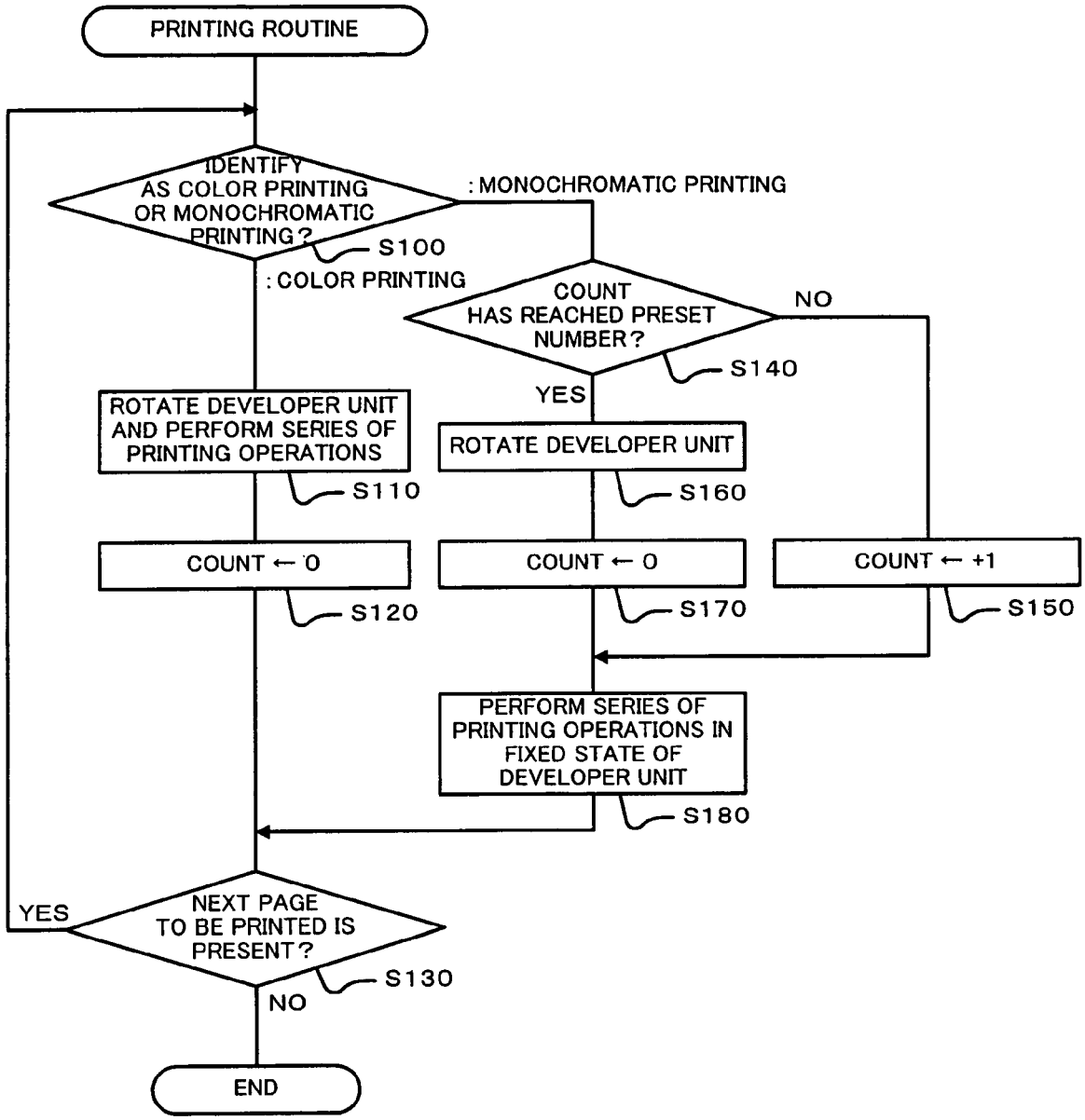
FIG. 3 is a flowchart showing a printing routine.

The following describes the operations of the color laser printer 10 of the embodiment constructed as discussed above. FIG. 3 is a flowchart showing a printing routine executed by the CPU 12 of the controller 11. This routine is stored in the ROM 13 and is executed by the CPU 12 in response to reception of a printing instruction from an external device (not shown) connecting with the color laser printer 10. The color laser printer 10 of this embodiment is capable of automatically identifying object image data to be printed as image data for a color image or image data for a monochromatic image. The positions of the toner cartridges 40 are not moved but are fixed in the case of monochromatic printing. When the routine of FIG. 3 starts, the CPU 12 first identifies an object image to be printed as a color image or a monochromatic image, in response to a received RGB signal (step S100).

When the object image to be printed is identified as a color image, the CPU 12 activates a color print mode to rotate the developer unit 61 and sequentially move the positions of the toner cartridges 40 for color printing (step S110). The CPU 12 first charges the photoreceptor 63 and controls the exposure unit 62 to expose the charged photoreceptor 63 and thereby form an electrostatic latent image for black on the photoreceptor 63. The CPU 12 then rotates the developer unit 61 to move and fix the toner cartridge 40K filled with black toner to a development position, that is, a position facing the photoreceptor 63. The CPU 12 subsequently controls the developer unit 61 to develop the electrostatic latent image formed on the photoreceptor 63 as a black toner image with a supply of charged toner from the toner cartridge 40K. The developed black toner image is then electrostatically transferred from the photoreceptor 63 onto the transfer belt 64 (primary transfer). This series of operations causes a black toner image to be formed on the transfer belt 64.

The CPU 12 repeatedly carries out this series of operations, that is, charging the photoreceptor 63, controlling the exposure unit 62 to expose the photoreceptor 63 and form an electrostatic latent image for each color component, controlling the developer unit 61 to develop the electrostatic latent image as a toner image of the color component, and transferring the toner image of the color component onto the transfer belt 64 in an overlapping manner, while the developer unit 61 is rotated by 90 degrees each to sequentially move and fix the toner cartridges 40 for cyan, magenta, and yellow to the development position. A composite color toner image as the overlapped color toner images is accordingly formed on the transfer belt 64. The rotation of the developer unit 61 to move the positions of the toner cartridges 40 makes a driving noise.

After formation of the four color toner images in the overlapping manner on the transfer belt 64, the CPU 12 controls the feeder unit 66 to feed a sheet of printing paper and subsequently controls the secondary transfer unit 67 to electrostatically transfer the composite color toner image from the transfer belt 64 onto the sheet of printing paper (secondary transfer). A fixation roller of the fixation unit 68 applies heat and pressure onto the composite color toner image to fuse and fix the respective color toners and thereby print a resulting color image on the sheet of printing paper.

On completion of printing one page in the color print mode at step S110, the CPU 12 resets the count on the counter 18 to zero (step S120) and determines the presence or absence of any next page to be printed (step S130). In the presence of any next page to be printed, the routine goes back to step S100 and continues the series of printing operations. In the absence of any next page to be printed, on the other hand, the printing routine is terminated. The counter 18 counts up the consecutive printing operations in the monochromatic print mode (see steps S150 to S170 discussed later). In the color printing process, the toner cartridges 40 are rotated with the rotation of the developer unit 61 to agitate the toners held therein. At the end time of color printing, the count on the counter 18 representing the number of consecutive monochromatic printing operations is thus reset to zero.

When the object image to be printed is identified as a monochromatic image at step S100, on the other hand, the CPU 12 reads the count on the counter 18 and determines whether the count on the counter 18 has reached a preset number (step S140). Here the count on the counter 18 represents the number of monochromatic printing operations and may be expressed, for example, by the number of operations of the photoreceptor, the transfer belt, or the fixation unit. In the color laser printer 10 of the embodiment, the count on the counter 18 is incremented by one on completion of printing each sheet of printing paper. The preset number may be empirically or experimentally determined by repeatedly carrying out monochromatic printing in the fixed state of the developer unit 61 and counting up the number of prints with evenly and homogeneously formed toner images. In the color laser printer 10 of the embodiment, the preset number is equal to 10.

When it is determined at step S140 that the count on the counter 18 has not yet reached the preset number, the CPU 12 increments the count on the counter 18 by one (step S150) and performs the series of printing operations without a rotation of the developer unit 61 to fix the toner cartridge 40K filled with black toner to the development position (step S180). The CPU 12 carries out the series of printing operations, that is, charging the photoreceptor 63, controlling the exposure unit 62 to expose the photoreceptor 63 and form an electrostatic latent image for black, controlling the developer unit 61 to develop the electrostatic latent image as a black toner image with a supply of black toner from the toner cartridge 40K, and transferring the black toner image onto the transfer belt 64, while the developer unit 61 is kept stationary. The CPU 12 then controls the feeder unit 66 to feed a sheet of printing paper and subsequently controls the secondary transfer unit 67 to electrostatically transfer the black toner image from the transfer belt 64 onto the sheet of printing paper (secondary transfer). The fixation roller of the fixation unit 68 applies heat and pressure onto the black toner image to fuse and fix the black toner and thereby print a resulting monochromatic image on the sheet of printing paper. In the monochromatic printing process, the toner cartridge 40K is kept stationary and is fixed to the development position. This arrangement desirably reduces the noise, compared with the prior art structure that performs the printing operations with rotation of the developer unit to move the positions of the toner cartridges.

When it is determined at step S140 that the count on the counter 18 has reached the preset number, the CPU 12 rotates the developer unit 61 and returns and fixes the toner cartridge 40K to the development position (step S160). The CPU 12 then resets the count on the counter 18 to zero (step S170) and performs the series of printing operations without a rotation of the developer unit 61 to fix the toner cartridge 40K filled with black toner to the development position (step S180). This control procedure desirably reduces the noise until the number of consecutive monochromatic printing operations reaches the preset number. When the number of consecutive monochromatic printing operations reaches the preset number, the control procedure agitates the toner kept in the toner cartridge to ensure even and homogeneous printing of toner images. In the color laser printer 10 of this embodiment, the developer unit 61 is rotated by approximately 360 degrees to return the toner cartridge 40K to the development position. The developer unit 61 may be rotated multiple times in one direction or may be rotated repeatedly both in normal and reverse directions.

On completion of printing one page in the monochromatic print mode at step S180, the CPU determines the presence or absence of any next page to be printed (step S130). In the presence of any next page to be printed, the routine goes back to step S100 and continues the series of printing operations. In the absence of any next page to be printed, on the other hand, the printing routine is terminated.

As described above, the color laser printer 10 of the embodiment identifies each object image to be printed as a color image or a monochromatic image. When the object image to be printed is identified as a color image, the control procedure rotates the developer unit 61 with the multiple color toner cartridges 40 to sequentially move the positions of the respective color toner cartridges 40 to the development position and forms respective color toner images on the photoreceptor 63. When the object image to be printed is identified as a monochromatic image, on the other hand, the control procedure fixes the toner cartridge 40K filled with black toner to the development position and forms a black toner image on the photoreceptor 63. After a preset number of consecutive monochromatic printing operations in the fixed state of the developer unit 61, the developer unit 61 is rotated by approximately 360 degrees to return and fix the toner cartridge 40K filled with black toner to the development position for monochromatic printing.

In the above embodiment, the developer unit 61 corresponds to a changeover mechanism of the present invention. The controller 11 of the embodiment corresponds to a changeover control module, a mode identification module, an image color judgment module, and a measured frequency judgment module of the invention. The counter 18 of the embodiment corresponds to a frequency measurement module of the invention. The embodiment described above also explains one example of a printing method of the invention.

The color laser printer 10 of the embodiment fixes the black toner cartridge 40K to the development position to form black toner images on the photoreceptor in the monochromatic print mode, whereas the prior art structure forms black toner images with change of the position of the black toner cartridge. The arrangement of the embodiment thus desirably reduces the noise due to the rotation of the developer unit 61. The control procedure of the embodiment desirably reduces the noise in the monochromatic print mode until the number of consecutive monochromatic printing operations reaches the preset number. When the number of consecutive monochromatic printing operations reaches the preset number, the control procedure changes the position of the toner cartridge to agitate the toner kept in the toner cartridge. This ensures even and homogeneous printing of toner images.

The above embodiment is to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

In the structure of the embodiment discussed above, the CPU 12 automatically identifies each object image data to be printed as color image data or monochromatic image data. The user may manually select either a color image or a monochromatic image. One applicable method of the user's selection asks the user to selectively enter either a color image or a monochromatic image in an input box included in a print instruction window, which is open, in response to a print instruction, on a display of an external device (for example, a computer) connecting with the color laser printer 10. Another applicable method provides the operation panel 15 of the color laser printer 10 with mode selection buttons for selection of either the color print mode or the monochromatic print mode. The color laser printer 10 receives the mode information from the external device or the mode selection buttons and identifies the print mode.

The control procedure of the embodiment discussed above fixes the black toner cartridge 40K to the development position to form black toner images in the monochromatic print mode. One modified structure may enable the user to select either monochromatic printing with rotation of the developer unit 61 to change the position of the toner cartridge as in the case of the color print mode or monochromatic printing in the fixed state of the developer unit 61. One applicable method of the user's selection asks the user to selectively enter either the monochromatic print mode with change of the position of the toner cartridge 40 or the monochromatic print mode at the fixed position of the toner cartridge 40 in an input box included in a print instruction window, which is open, in response to a print instruction, on a display of an external device (for example, a computer) connecting with the color laser printer 10. Another applicable method provides the operation unit 17 in the operation panel 15 of the color laser printer 10 with mode selection buttons for selection of either the monochromatic print mode with change of the position of the toner cartridge 40 or the monochromatic print mode at the fixed position of the toner cartridge 40.

The control procedure of the embodiment discussed above fixes the toner cartridge 40K filled with black toner to the development position for monochromatic printing. The control procedure may also fix each color toner cartridge filled with cyan, magenta, or yellow toner to the development position for homochromatic printing of the corresponding color. This also exerts the effects of the invention discussed above.

In the structure of the embodiment discussed above, when the count on the counter 18 representing the number of consecutive monochromatic printing operations in the fixed state of the developer unit 61 reaches the preset number, the control procedure rotates the developer unit 61 to return and fix the toner cartridge 40K to the original development position for monochromatic printing. One possible modification may use a timer that measures the time of consecutive monochromatic printing in the fixed state of the developer unit 61. When the measured time reaches a preset value, the control procedure rotates the developer unit 61 to return and fix the toner cartridge to the original development position for monochromatic printing. This arrangement also desirably reduces the noise in the monochromatic print mode until the time of consecutive monochromatic printing reaches the preset value. When the time of consecutive monochromatic printing reaches the preset value, the control procedure changes the position of the toner cartridge to shake or agitate the toner kept in the toner cartridge. This ensures even and homogeneous printing of toner images. The 'preset value' may be empirically or experimentally determined by repeatedly carrying out printing in the monochromatic print mode and measuring the time of consecutive monochromatic printing with evenly and homogeneously formed toner images.

Another possible modification may utilize an image patch as a text pattern to keep printed images at a practically constant density. The image patch is developed and formed on the photoreceptor 63 with a supply of black toner from the toner cartridge 40K. The density of the image patch formed on the photoreceptor 63 is measured with a density sensor, which is located at a position facing the photoreceptor 63 and has a light-emitting element and a light-receiving element to measure the reflectance. When the density of the image patch on the photoreceptor 63 measured with the density sensor in the monochromatic print mode becomes lower than a preset level, the control procedure rotates the developer unit 61 to return and fix the toner cartridge to the original development position for monochromatic printing. This arrangement also desirably reduces the noise in the monochromatic print mode until the observed density of the image patch as the test pattern formed on the photoreceptor 63 becomes lower than the preset level. When the density of the image patch becomes lower than the preset level, for example, when the image patch formed on the photoreceptor 63 has some white streaks, the control procedure changes the position of the toner cartridge to shake or agitate the toner kept in the toner cartridge. This ensures even and homogeneous printing of toner images. The test pattern used to measure the density is not restricted to the image patch but may be any image usable for measurement of the density, for example, a toner image of an object image to be printed or a resulting printed image. The image patch is formed on the photoreceptor 63 for measurement of the density. This is, however, not restrictive, and the image patch may be formed in any process of development, transfer, or fixation. For example, the image patch may be formed on the transfer belt 64 or on the sheet of printing paper. The position of the density sensor is not restricted to the position facing the photoreceptor 63 but may be any suitable position for measurement of the density of the image, for example, a position facing the transfer belt 64 or a position facing the sheet of printing paper going through the fixation unit 68. The 'preset level' may be empirically or experimentally determined by repeatedly carrying out printing in the monochromatic print mode and measuring the density of prints with evenly and homogeneously formed toner images.

Figure 4:
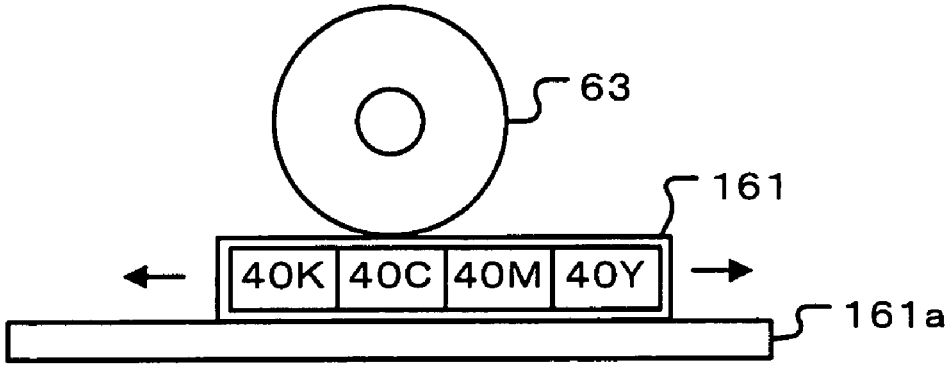
FIG. 4 shows movements of (a) a horizontally-movable developer unit and (b) a vertically-movable developer unit in a modified example.
Figure 4:
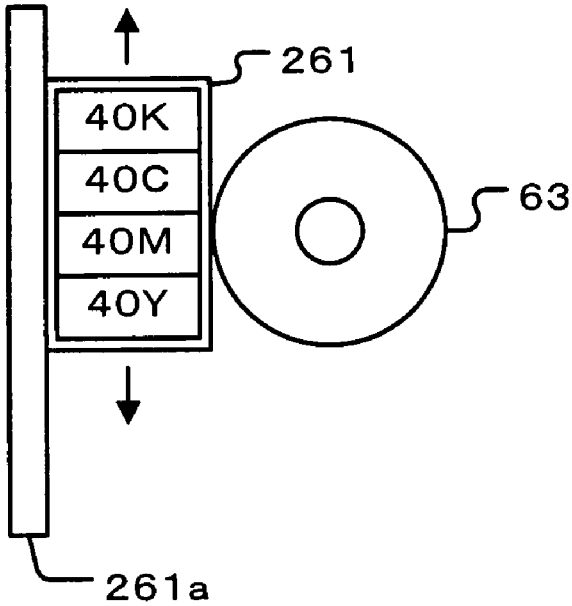

In the structure of the embodiment discussed above, the developer unit 61 is designed to be rotatable and have the multiple toner cartridges 40 arranged about its rotating shaft 61*a*. This structure and operation of the developer unit is, however, not restrictive at all. One modified example is a developer unit 161 designed to have a structure shown in FIG. 4(*a*). The developer unit 161 is horizontally movable along a guide mechanism 161*a* and has multiple toner cartridges arranged in the horizontal direction. Another modified example is a developer unit 261 designed to have a structure shown in FIG. 4(*b*). The developer unit 261 is vertically movable along a guide mechanism 261*a* and has multiple toner cartridges arranged in the vertical direction. These structures also exert the effects of the invention.

What is claimed is:

1. A printing device that is capable of printing in a color print mode and printing in a monochromatic print mode, said printing device comprising:

multiple toner cartridges that are respectively filled with toners of multiple colors used for color printing;

a changeover mechanism that sequentially moves positions of the multiple toner cartridges to a development position, where each color toner image is formed on a photoreceptor with a supply of corresponding color toner from one of the multiple toner cartridges located at the development position;

a mode identification module that identifies either the color print mode or the monochromatic print mode; and a changeover control module that controls said changeover mechanism, in response to identification as the color print mode by said mode identification module, to sequentially move the positions of the multiple toner cartridges to the development position and form respective color toner images on the photoreceptor, said changeover control module controlling said changeover mechanism, in response to identification as the monochromatic print mode by said mode identification module, to fix the position of a specific toner cartridge filled with a specific color toner used for monochromatic printing to the development position and form a monochromatic toner image on the photoreceptor;

a frequency measurement module that measures a number of consecutive printing operations in the monochromatic print mode; and a measured frequency judgment module that determines whether the number of consecutive printing operations in the monochromatic print mode measured by said frequency measurement module reaches a preset number, wherein said changeover control module, in response to determination of said measured frequency judgment module that the measured number of consecutive printing operations in the monochromatic mode reaches the preset number, controls said changeover mechanism to once move the positions of the multiple toner cartridges and then fix the position of the specific toner cartridge filled with the specific color toner for monochromatic printing to the development position to form the monochromatic toner image on the photoreceptor.

2. A printing device in accordance with claim 1, wherein said changeover mechanism rotates a rotating shaft, around which the multiple toner cartridges are arranged, to sequentially move the positions of the multiple toner cartridges to the development position.

3. A printing device in accordance with claim 1, said printing device further comprising:

a mode information acquisition module that obtains mode information representing a user's selection of either the color print mode or the monochromatic print mode, wherein said mode identification module identifies either the color print mode or the monochromatic print mode, based on the mode information obtained by said mode information acquisition module.

4. A printing device in accordance with claim 1, said printing device further comprising:

an image color judgment module that judges object image data to be printed as color image data or monochromatic image data, wherein said mode identification module identifies either the color print mode or the monochromatic print mode, based on a judgment result by said image color judgment module.

5. A printing device in accordance with claim 1, said printing device further comprising:

a time measurement module that measures a time of consecutive printing in the monochromatic print mode; and a measured time judgment module that determines whether the time of consecutive printing in the monochromatic print mode measured by said time measurement module reaches a preset value, wherein said changeover control module, in response to determination of said measured time judgment module that the measured time of consecutive printing in the monochromatic mode reaches the preset value, controls said changeover mechanism to once move the positions of the multiple toner cartridges and then fix the position of the specific toner cartridge filled with the specific color toner for monochromatic printing to the development position to form the monochromatic toner image on the photoreceptor.

6. A printing device in accordance with claim 1, said printing device further comprising:

a density measurement module that measures a density of an image formed in the monochromatic print mode, wherein said changeover control module, in response to a detection that the density of the image measured by said density measurement module is lower than a preset level in the monochromatic print mode, controls said changeover mechanism to once move the positions of the multiple toner cartridges and then fix the position of the specific toner cartridge filled with the specific color toner for monochromatic printing to the development position to form the monochromatic toner image on the photoreceptor.

7. A printing method attained by a computer software program that sequentially moves positions of multiple toner cartridges, which are respectively filled with toners of multiple colors used for color printing, to a development position, where each color toner image is formed on a photoreceptor with a supply of corresponding color toner from one of the multiple toner cartridges located at the development position, said printing method comprising the steps of:

(a) identifying either a color print mode or a monochromatic print mode; and (b) in case of identification as the color print mode by said step (a), sequentially moving the positions of the multiple toner cartridges to the development position and form respective color toner images on the photoreceptor, while in case of identification as the monochromatic print mode by said step (a), fixing the position of a specific toner cartridge filled with a specific color toner used for monochromatic printing to the development position and form a monochromatic toner image on the photoreceptor, wherein said step (b), when a number of consecutive printing operations in the monochromatic mode reaches a preset number, controls said changeover mechanism to once move the positions of the multiple toner cartridges and then fix the position of the specific toner cartridge filled with the specific color toner used for monochromatic printing to the development position to form the monochromatic toner image on the photoreceptor.

8. A printing method in accordance with claim 7, wherein said step (a) identifies either the color print mode or the monochromatic print mode, based on mode information obtained from a user.

9. A printing method in accordance with claim 7, wherein said step (a) judges object image data to be printed as color image data or monochromatic image data, and identifies either the color print mode or the monochromatic print mode, based on a result of the judgment.

10. A printing method in accordance with claim 7, wherein said step (b), when a time of consecutive printing in the monochromatic mode reaches a preset value, controls said changeover mechanism to once move the positions of the multiple toner cartridges and then fix the position of the specific toner cartridge filled with the specific color toner used for monochromatic printing to the development position to form the monochromatic toner image on the photoreceptor.

11. A printing method in accordance with claim 7, wherein said step (b), when density of an image is lower than a preset level in the monochromatic print mode, controls said changeover mechanism to once move the positions of the multiple toner cartridges and then fix the position of the specific toner cartridge filled with the specific color toner used for monochromatic printing to the development position to form the monochromatic toner image on the photoreceptor.

12. A printing device in accordance with claim 1, wherein when the number of consecutive monochromatic printing operations reaches the preset number, the changeover control module agitates toner in the toner cartridge to ensure even and homogeneous printing of a plurality of toner images.

13. A printing device in accordance with claim 1, wherein the multiple toner cartridges are rotated multiple times in one direction or rotated repeatedly both in normal and reverse directions.

14. A printing device in accordance with claim 1, wherein the preset number is determined by repeatedly carrying out monochromatic printing and counting up the number of prints with evenly and homogeneously formed toner images.

15. A printing device in accordance with claim 1, wherein the preset number is equal to 10.

* * * * *